US006247279B1

(12) United States Patent
Murat et al.

(10) Patent No.: US 6,247,279 B1
(45) Date of Patent: Jun. 19, 2001

(54) RETROFITTING EXISTING CONCRETE COLUMNS BY EXTERNAL PRESTRESSING

(75) Inventors: Saatcioglu Murat, Gloucester; Yalcin Cem, Ottawa, both of (CA)

(73) Assignee: University of Ottawa (CA)

( * ) Notice: Subject to any disclaimer, the term of this patent is extended or adjusted under 35 U.S.C. 154(b) by 0 days.

(21) Appl. No.: 09/275,740

(22) Filed: Mar. 24, 1999

Related U.S. Application Data

(60) Provisional application No. 60/111,867, filed on Dec. 11, 1998.

(51) Int. Cl.[7] ..... E04C 5/08; E04C 23/02; E04C 3/34

(52) U.S. Cl. ..... 52/223.3; 52/223.13; 52/223.14; 52/231; 52/248; 52/514; 52/721.4; 52/741.3

(58) Field of Search ..... 52/170, 223.3, 52/223.13, 223.14, 231, 514, 721.4, 741.3, DIG. 7, 245, 248, 244

(56) References Cited

U.S. PATENT DOCUMENTS

| | | |
|---|---|---|
| 2,873,503 | 2/1959 | Davis . |
| 3,523,063 | 8/1970 | Zerna . |

(List continued on next page.)

FOREIGN PATENT DOCUMENTS

| | | |
|---|---|---|
| 32 03 592 | 8/1983 | (DE) . |
| 38 06 759 | 9/1989 | (DE) . |
| 197 02 247 | 7/1998 | (DE) . |
| 1 446 425 | 8/1976 | (GB) . |
| WO 94/24391 | 10/1994 | (WO) . |

OTHER PUBLICATIONS

Coffman et al., "Seismic Durability of Retrofitted Reinforced–Concrete Columns" Journal of Structural Engineering, May 1993, vol. 119, NR 5, pp. 1643–1661.

(List continued on next page.)

*Primary Examiner*—Christopher T. Kent
(74) *Attorney, Agent, or Firm*—Killworth, Gottman, Hagan & Schaeff, L.L.

(57) ABSTRACT

A large number of existing reinforced concrete structures, such as buildings and bridges, if subjected to abnormal loads, such as those expected during earthquakes or bomb blast, may experience significant inelasticity in their critical regions. It is economically not feasible to replace the entire existing infrastructure with new and improved structures; retrofitting provides the only solution to the problem of seismically and otherwise structurally deficient existing structures. A new retrofitting process has been developed to improve strength and deformability of existing reinforced concrete columns. The process involves determining column critical regions, identifying critical stresses that may lead to brittle shear and/or compression failures, determining external prestressing to overcome some of these stresses and to provide lateral confining pressure to improve the ductility of compression concrete. External prestressing is provided by placing prestressing hoops around the column at predetermined locations. Each loop includes a strand that encircles the column with its ends fixed under tension to an anchor. The invention is applicable to concrete columns of any geometric cross-section. For circular columns prestressing may be applied directly on the surface of the column by the strands. For columns with rectilinear geometry such as square, rectangular and other polygonal cross-sectional shapes, additional hardware is necessary between the strand and the flat surfaces to distribute the prestressing force as evenly as possible on the surfaces of the column. External protection of hardware against corrosion, fire and vandalism may be carried out by means of fiber reinforced or plain concrete jackets, shotcreeting or similar sprayed applications of cement based materials, and different types of paints.

30 Claims, 9 Drawing Sheets

U.S. PATENT DOCUMENTS

| | | | | |
|---|---|---|---|---|
| 3,939,665 | | 2/1976 | Gosse et al. . | |
| 3,990,600 | | 11/1976 | Rossitto et al. . | |
| 4,075,801 | * | 2/1978 | Alper et al. | 52/223.3 X |
| 4,207,716 | * | 6/1980 | Moldrup | 52/248 X |
| 5,043,033 | | 8/1991 | Fyfe . | |
| 5,251,421 | * | 10/1993 | Friedrich et al. | 52/248 X |
| 5,444,952 | | 8/1995 | Jackson . | |
| 5,633,057 | | 5/1997 | Fawley . | |
| 5,680,739 | | 10/1997 | Cercone et al. . | |
| 5,960,597 | * | 10/1999 | Schwager | 52/223.14 X |

OTHER PUBLICATIONS

Frangou et al., "Structural Repair/Strengthening of RC Columns" Construction and Building Materials, vol. 9, No. 5, 1995, pp. 259–266.

Ian G. Buckle, "Seismic Retrofitting Experience and Experiments in Illinois" Proceedings of the Fourth National Workshop on Bridge Research in Progress, Jun. 17–19, 1996, Buffalo, New York, pp. 246–250.

* cited by examiner

RETROFITTING EXISTING CONCRETE COLUMNS BY EXTERNAL PRESTRESSING

This application claims the benefit of Provisional No. 60/111,867 filed Dec. 11, 1998.

FIELD OF THE INVENTION

This invention relates generally to reinforced concrete structures and more particularly it is directed to concrete columns in buildings, bridges, and other types of structures.

BACKGROUND OF THE INVENTION

Concrete columns are used in buildings, bridges and other structures to support axial compression and resist flexural and shear stresses. They are often reinforced with reinforcement consisting of longitudinal and transverse steel. The longitudinal reinforcement contributes to axial and flexural resistance. The transverse reinforcement contributes to improving shear (diagonal tension) capacity, preventing or delaying buckling of longitudinal reinforcement in compression, and confining concrete to improve strength and deformability of concrete. While the amount of longitudinal reinforcement affects flexural and axial strength, it does not play a significant role on column deformability. However, the transverse reinforcement plays a vital role on column shear strength and deformability. Columns are often required to be designed with sufficient transverse reinforcement, in the form of ties, hoops, overlapping hoops and crossties for excess shear capacity to prevent premature shear failure, which is regarded as a brittle form of failure. Hence, in properly designed concrete columns, brittle shear failure never precedes ductile flexural failure.

The same transverse reinforcement also improves flexural performance if placed with sufficiently small spacing. Closely spaced transverse reinforcement provides a reinforcement cage which confines the compression concrete. Concrete in compression develops a tendency to expand laterally due to the Poisson's effect. Lateral expansion generates transverse tensile strains and longitudinal splitting cracks which eventually result in failure. The presence of closely spaced transverse reinforcement controls the development of splitting cracks and delays the failure of concrete. Lateral expansion of concrete is counteracted by passive confinement pressure exerted by reinforcement. The resulting confinement action enhances both the strength and deformability of concrete. These improvements directly translate into flexural strength enhancement, as well as a very significant increase in inelastic deformability.

Performance of buildings and bridges during recent earthquakes indicated serious design deficiencies, especially when stresses exceed elastic limits of materials. For example, the majority of bridge failures in the 1994 Northridge Earthquake were attributed to lack of shear and/or confinement reinforcement in columns. Similarly, a large number of building failures during past earthquakes have been attributed to poor column behavior, especially due to lack of shear/confinement reinforcement. A large number of bridges were found to have seismic deficiencies in the State of California alone. These structures need to be retrofitted for improved strength and ductility.

Columns of multistory buildings are often critical at the first story level, where they may be subjected to plastic hinging due to excessive flexural stress reversals, or shear distress caused by high seismic shear forces. These columns are often fixed to the foundation, and are built monolithically with the structure. Hence, they often deform in double curvature, developing high flexural stresses at the ends, near the supports, where they are restrained against bending. These end regions may become critical for flexure. High flexural tensile stresses may develop, causing the column longitudinal reinforcement yield, initiating ductile response until compressive stresses in concrete result in the crushing of the concrete. Concrete crushing is a brittle form of failure, leading to sudden and immediate loss of strength. One viable approach to prevent the brittle failure of concrete in compression is to provide lateral confinement. Confined concrete is laterally restrained against possible expansion. Axially compressed concrete can not crush unless it expands laterally due to the Poisson effect and develops vertical tensile cracks. The lateral pressure provided by confinement overcomes the tendency to expand, improving strength and ductility of concrete. In new construction the building code requirements for internally placed transverse confinement reinforcement results in sufficient lateral confinement to improve deformability of columns. In existing columns, however, built prior to the development of current code provisions, lack of properly designed transverse reinforcement results in brittle failures. Hence these columns fail due to compression crushing of concrete unless retrofitted externally to provide the required confinement.

Similar critical regions may develop in bridge columns. These columns are built to be fixed against flexural rotation at their footings. Hence, the column end near the footing may be critical against flexure and hence compression crushing. Certain bridge columns are monolithically built with the bridge deck. These columns may also have a critical region near the deck. However, bridge columns may also have a hinge support at their ends near the deck. The latter category of columns are not subjected to significant flexure near the deck, and hence are not critical at this location.

Confined concrete also provides proper anchorage to reinforcement. Therefore, lap splice regions of longitudinal reinforcement are often required to be confined, if the bars are at or near the potential hinging regions. Hence, confining concrete also results in beneficial effects in lap splice regions.

Both building and bridge columns may attract significant shear forces if they are short. Short and stubby columns may be critical in shear, developing diagonal tension and compression failures along their heights. Diagonal tension failure in a concrete column occurs when transverse column steel is not adequate. In such a case, the column fails prematurely, prior to developing its flexural capacity. While flexural yielding and associated flexural hinging may lead to ductile response, especially if the column is well confined, diagonal tension failure results in a sudden and brittle failure. Therefore, these columns must be retrofitted externally to prevent brittle shear failure. Although rare, some shear-dominant columns may experience diagonal compression crushing of concrete if diagonal shear failure is prevented by excessive transverse reinforcement. Concrete confinement helps in this case, improving the behavior of concrete against diagonal compression.

It is clear from the above discussion that the transverse reinforcement plays a significant role on inelastic deformability of concrete columns. While properly designed transverse reinforcement is required by building codes in all new columns, its function can be fulfilled by external prestressing in old and existing columns which may not possess adequate transverse reinforcement. Retrofitting through external prestressing has the added advantage of providing actively applied lateral pressure. Active lateral pressure delays the formation of diagonal shear cracks in columns, and limits widths of such cracks, improving aggregate interlock and consequently increasing concrete contribution to shear resistance. The active pressure also increases lateral confinement and enhances the mechanism of concrete confinement, while also restraining longitudinal reinforcement against buckling.

The most commonly used prior art for column retrofitting is steel jacketing. Steel jacketing involves covering the column surface by steel plates, welding the plates to form a sleeve, and filling the gap between the steel and concrete by pressure injected grout. The steel jacket overcomes diagonal tensile and compressive stresses generated by shear, while also restraining concrete against lateral expansion, thereby confining the column for improved deformability. In circular columns, passive confinement pressure is developed from hoop tension in the steel jacket as the concrete expands laterally. However, the same mechanism cannot be utilized in square and rectangular columns, unless the column is first re-shaped to have an elliptical or circular shape before a steel jacket is put in place. The steel jacketing can be quite costly because of the large amounts of steel used and each steel jacket has to be custom made especially for non-circular columns. However, because of lack of availability of a more practical and economical technique, steel jacketing forms the majority of recent applications for column retrofitting.

Jacketing concrete columns can also be done by providing a reinforced concrete sleeve around existing columns. This technique requires placement of reinforcement cage around the existing column which may be quite cumbersome especially because of the substantial amount of closely spaced transverse reinforcement that has to be placed around the column. Another complication is to provide the formwork and place concrete in the sleeve. The mechanism of confinement and shear force resistance remains the same as that for steel jacketing.

Another retrofitting technique, that is being researched and developed for concrete columns, is fiber wrap, involving fiber reinforced polymer (FRP) materials. This technique involves covering the surface of concrete column by an FRP wrap, which provides passive confinement pressure as the concrete expands laterally under compression. While this technique was proven to be effective for concrete confinement, its use against diagonal tension caused by shear is still questionable. Furthermore, the high cost of material, the emission of toxic odors that can harm individuals in indoor applications and the lack of experience with long term durability of the material appear to be disadvantages that currently prevent widespread use of this technology. Although the application of FRP in circular columns shows promising results, in the case of rectilinear or polygonal columns, this technique has some drawbacks such as lack of concrete confinement and brittle failures at sharp corners of the columns. The above prior art techniques are discussed in the U.S. Pat. No. 5,680,739 which issued to Cercone et al on Oct. 28, 1997.

From the foregoing discussion, it is concluded that an economically viable, structurally effective and durable, and practically superior retrofitting technique is needed in the construction industry for concrete columns. The need to upgrade concrete columns remains a challenge to structural engineers, especially in seismically active regions.

SUMMARY OF THE INVENTION

It is therefore an object of the present invention to provide a method and hardware for retrofitting concrete columns by externally prestressing them.

This and other objects are achieved in a process and hardware for retrofitting concrete columns to improve resistance of concrete structures against abnormal loads, such as those encountered during earthquakes and bomb blasts, which are likely to create inelasticity in columns.

The method of retrofitting a concrete column comprises the steps of determining reinforcement requirements for the column to be retrofitted and selecting appropriate hoops for mounting about the column to impart lateral stress to the column. The hoops include strands that encircle the column with the ends joined by an anchor. The hoops are mounted about the column at predetermined spaced vertical locations. The tension of the strands in the hoops is adjusted to meet the predetermined reinforcement requirements. In addition, the hoops or the hoops and the column may be covered with a protective coating.

In accordance with another aspect of the invention, requirement for reinforcement may be determined by calculating if $V_{prob} \geqq V_u$ where $V_{prob}$ is the probable shear force and $V_u$ is the design shear capacity of the column. In addition, if the existing transverse in the column does not conform to predetermined confinement steel requirements, retrofitting of the column is required. In addition, to compensate the shear deficiency in a column, $A_{str\text{-}shear}$—the cross-sectional area of a high-tensile prestressing strand in $mm^2$ is calculated; to compensate the confinement deficiency in a column, $A_{str\text{-}confine}$—the cross-sectional area of a high-tensile prestressing strand in $mm^2$ is calculated. Strand selection is then based on the larger of the two cross-sectional areas $A_{str\text{-}shear}$ and $A_{str\text{-}confine}$.

$A_{str\text{-}shear}$ is determined from the equation:

$$A_{str-shear} = \frac{[V_{prob} - V_u]S_{str}}{2(1-\alpha_f)\phi_{str}f_{ystr}b}\tan\Theta$$

where $V_{prob}$ is the shear force corresponding to probable flexural resistance of the column and may be taken as 1.25 times the nominal flexural capacity of the column divided by the shear span in newtons (N); $V_u$ is design shear capacity of the column in N; $s_{str}$ is the spacing of the hoops in the longitudinal direction in mm; $\Theta$ is the inclination of the assumed failure surface caused by diagonal tension and may be taken as 45°; $\alpha_f$ is the ratio of initial prestress to yield strength of the strand; $\phi_{str}$ is the capacity reduction factor of the strand that can be taken as 0.9; $f_{ystr}$ is the yield strength of strand in MPa; and b is the diameter of a circular column or the cross-sectional side dimension of a rectilinear column in the direction of shear force in mm.

It has been determined that the first hoop may be placed at approximately 75 mm above the base of the column and the other hoops at intervals of b/4 or 150 mm whichever is the lesser.

$A_{str\text{-}confine}$ is determined from the equation:

$$A_{str-confine} \geq \frac{f'_c}{f_{ystr}}\frac{bs}{1000}\left(4 + 50\frac{P_f}{P_{or}}\right).$$

where $f_c$ is the compressive strength in MPa as determined by a standard cylinder test; $f_{ystr}$ is the yield strength of the strand in MPa; b is the diameter of a circular column or the cross-sectional side dimension of a rectilinear column parallel to the axis of bending in mm; $s_{str}$ is the spacing of the hoops in the longitudinal direction in mm; $P_f$ is the factored axial compressive force due to the combination of gravity and lateral loads in N and $P_{or}$ is the factored concentric capacity of the column in N.

Another aspect of this invention is a number of kits for retrofitting concrete columns having a curved surface or substantially flat surfaces. All kits include a plurality of high tensile strands for mounting about the column that can be in the form of one or more strand lengths and a plurality of anchors forjoining the two ends of the strands under tension. The kits for the columns with substantially flat surfaces further include a plurality of raisers for placement between each strand and adjacent flat surfaces of the column as well as a plurality of corner spacers or raisers for placement between each strand and adjacent corners formed by adjacent flat surfaces. In addition, the raisers between the strand and the substantially flat surfaces are constructed such that the strand will form an approximate parabolic curve where the ratio between the length of the flat surface and the perpendicular distance between a line joining the ends of the parabolic curve and the peak of the parabolic curve is in the order of 5 to 10:1.

In accordance with another aspect of this invention, the anchor for joining two strand ends under tension comprises a block having two adjacent holes passing through the block and defining adjacent paths that twist around one another resulting in adjacent openings on opposite ends of the block. The holes are adapted to receive the ends of the strands. In addition, one opening for each hole located at opposite ends of the block has tapered walls for receiving a tapered wedge, the wedges fix the ends of the strand under tension within the block.

Many other objects and aspects of the present invention will be clear from the detailed description of the drawings.

BRIEF DESCRIPTION OF THE DRAWINGS

Embodiments of the invention are described with reference to the drawings in which:

FIG. 1(*b*) is an elevation view of a typical bridge column to which this invention may be applied;

FIG. 2(*b*) is a cross section view of a rectilinear column;

FIG. 2(*c*) is a cross section view of a polygonal column;

FIG. 5(*b*) is a horizontal view in cross-section of a Dywidag anchor;

FIG. 6(*b*) is a horizontal view cross-section of the anchor device described in FIG. 6(*a*);

FIG. 10(*b*) is a cross-section of the retrofitted square cross-section column described in FIG. 10(*a*);

FIG. 11(*b*) is a cross-section of the retrofitted rectilinear column described in FIG. 11(*a*);

FIG. 12(*b*) is a horizontal view of the raiser described in FIG. 12(*a*);

FIG. 13(*b*) is a partial horizontal view of the corner unit described in FIG. 13(*a*);

FIG. 13(*c*) is a partial front view of the corner unit described in FIG. 13(*a*);

FIG. 14(*b*) is a graph of the performance of a "retrofitted" circular column in a cyclic test;

FIG. 15(*b*) is a graph of the performance of a "retrofitted" square column in a cyclic test.

DETAILED DESCRIPTION OF THE DRAWINGS

Figure 1A:
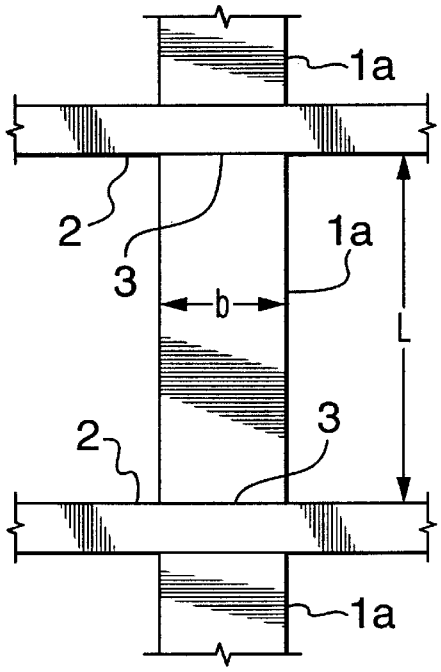
FIG. 1(*a*) is an elevation view of atypical building column to which this invention may be applied.
Figure 1B:
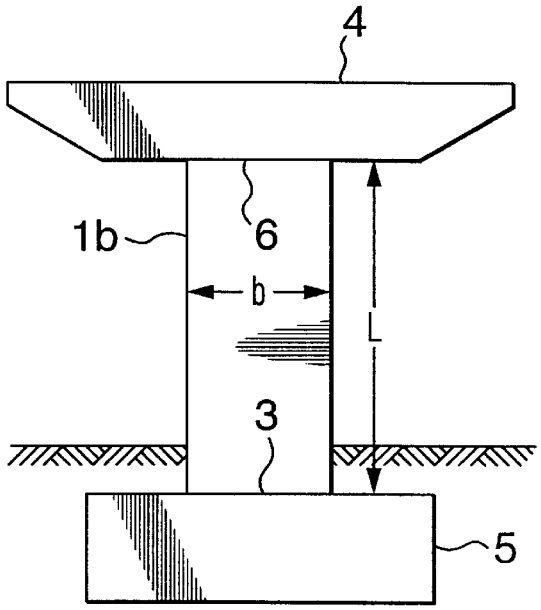

FIG. 1(*a*) shows a typical building column 1*a* resting between floor slabs 2. FIG. 1(*b*) shows a typical bridge column 1*b* resting between the bridge deck 4 and the foundation 5. The columns Ia in buildings are monolithic 3 to the floor slabs 2, whereas in bridges the columns 1*b* are monolithic 3 to the foundation 5 and monolithic 3 or hinged 6 to the bridge deck 4. The columns 1*a* or 1*b* are normally made out of concrete material with or without embedded vertical reinforcing steel and transverse hoops or ties.

Figure 2A:
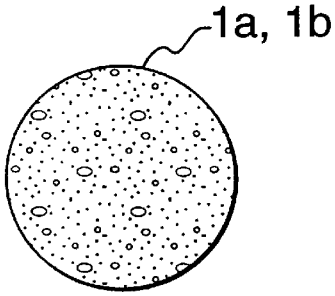
FIG. 2(*a*) is a cross section view of a circular column.
Figure 2B:
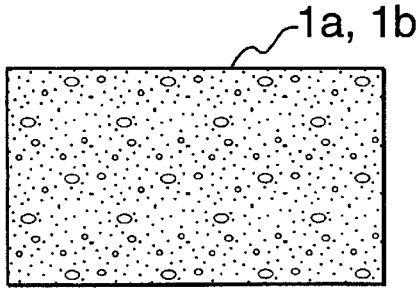
Figure 2C:
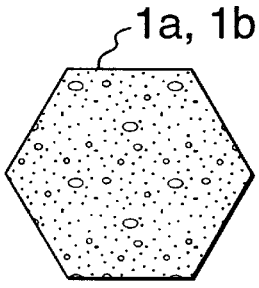

Columns 1*a* and 1*b* come in different shapes and sizes. FIG. 2(*a*) illustrates a cross-section of a circular column 1*a* or 1*b*, FIG. 2(*b*) illustrates a cross-section of a rectilinear column 1*a* or 1*b*, and FIG. 2(*c*) illustrates a cross-section of a polygonal column 1*a* or 1*b* which in this particular case is a hexagonal column 1*a* or 1*b*.

During severe loading, such as an earthquake, the column 1*a* or 1*b* is subjected to a lateral load as well as its own weight acting as an axial load. The top and bottom ends of the columns 1*a* or 1*b* having monolithic connections 3 are subjected to double bending action and their corresponding shear span may be shorter than the actual column length L. The bottom end of the columns 1*a* or 1*b* having monolithic connections 3 and top end of the columns having hinged connections 6 are subjected to single bending action and their corresponding shear span may be taken as the fill column length L.

The present invention involves retrofitting columns such as those illustrated in FIGS. 1*a*, 1*b*, 2*a*, 2*b* and 2*c* among others to increase strength and deformability (ductility) of the concrete columns during seismic and similar extreme events, including explosions. For the concrete columns that require it, the strength and deformability of the concrete columns can be improved to better withstand seismic shear and flexural force reversals. The retrofits in accordance with the present invention are carried out on location.

The retrofit method in accordance with the present invention comprises the following steps for any particular column which is being considered for retrofitting:

1—Calculate the design shear capacity $V_u$ in the column;

2—Determine the shear force $V_{prob}$ corresponding to probable moment capacity by performing a sectional analysis in any manner known to one skilled in the art as presently required by the ACI 318-95 Building Code or the CSA A23 .3 Standard.

3—The probable shear force $V_{prob}$ determined in step 2 is compared to the design shear capacity $V_u$. If $V_{prob} \geqq V_u$, then retrofitting is required. If however the probable shear force $V_{prob}$ is smaller, retrofitting is not required because of a deficiency in shear, but may still be required to confine concrete to assure sufficient deformability (ductility).

4—If the existing transverse reinforcement in the column does not conform to the confinement steel requirements spelled out in the most recent building code, retrofitting of the column is required.

Steps 1 to 4 are carried out to determine if a particular column requires to be retrofitted in order to meet the deformability requirements.

The process for retrofitting columns in accordance with the present invention comprises the external application of hoops made with strands with their ends joined under tension around the column at discrete locations throughout the column length. These hoops are stressed to provide near uniform lateral pressure on the column face at these discrete locations. The level of prestressing that is applied to the strands in the hoops may be set at from substantially zero which provides a snug fit to 40% of $f_{ystr}$ which is the yield strength of the strand in MPa, however up to 25% of $f_{ystr}$ is preferred.

The prestressing force applied to concrete columns overcomes diagonal tensile forces generated during seismic excitation and eliminates premature shear failure. It also applies lateral pressure to confine concrete. Confined concrete exhibits ductile characteristics and does not crush in a sudden and explosive manner under seismic induced compressive stresses. Hence, columns retrofitted with external transverse prestressing show improved strength and ductility, which are the two most important qualities sought for seismic resistance of any structural element. Research showed that active and evenly distributed pressure applied on the column face has significantly improved the column's deformation behavior by eliminating premature shear failure while increasing confinement for improved strength and ductility.

When retrofitting is required due to a deficiency of shear, ie $V_{prob} \geqq V_u$, the required cross section area in mm$^2$ $A_{str\text{-}shear}$ of the high-tensile strand in a hoop is given as the following:

$$A_{str-shear} = \frac{[V_{prob} - V_u]S_{str}}{2(1-\alpha_f)\phi_{str} f_{ystr} b}\tan\Theta$$

where $V_{prob}$ is the shear force corresponding to probable flexural resistance of the column and may be taken as 1.25 times the nominal flexural capacity of the column divided by the shear span in newtons (N); $V_u$ is design shear capacity of the column in N; $s_{str}$ is the spacing of the hoops in the longitudinal direction in mm; $\Theta$ is the inclination of the assumed failure surface caused by diagonal tension and may be taken as 45°; $\alpha_f$ is the ratio of initial prestressing strength to yield strength of the strand; $\phi_{str}$ is the capacity reduction factor of the strand that can be taken as 0.9; $f_{ystr}$ is the yield strength of strand in MPa; and b is the diameter of a circular column or the cross-sectional side dimension of a rectilinear column in the direction of shear force in mm.

The spacing, $s_{str}$, of the external strands must be at b/4 or 150 mm, whichever is less, for confinement of concrete and stability of longitudinal reinforcement. This follows very closely design requirements for the placement of transverse reinforcement hoops in the columns. The first external strand must be positioned not more than 75 mm away from the bottom end of the column.

When retrofitting is required due to a deficiency of confinement, the required cross section area in mm$^2$ $A_{str\text{-}confine}$ of the high-tensile strand in a hoop is given as the following:

$$A_{str-confine} \geq \frac{f_c'}{f_{ystr}} \frac{bs}{1000}\left(4 + 50\frac{P_f}{P_{or}}\right)$$

where $f_c$ is the compressive strength in MPa as determined by a standard cylinder test; $f_{ystr}$ is the yield strength of strand in MPa; b is the diameter of a circular column or the cross-sectional side dimension of a rectilinear column parallel to the axis of bending in mm; $s_{str}$ is the spacing of the hoops in the longitudinal direction in mm; $P_f$ is the factored axial compressive force due to the combination of gravity and lateral loads in N and $P_{or}$ is the factored concentric capacity of the column in N.

Figure 3:
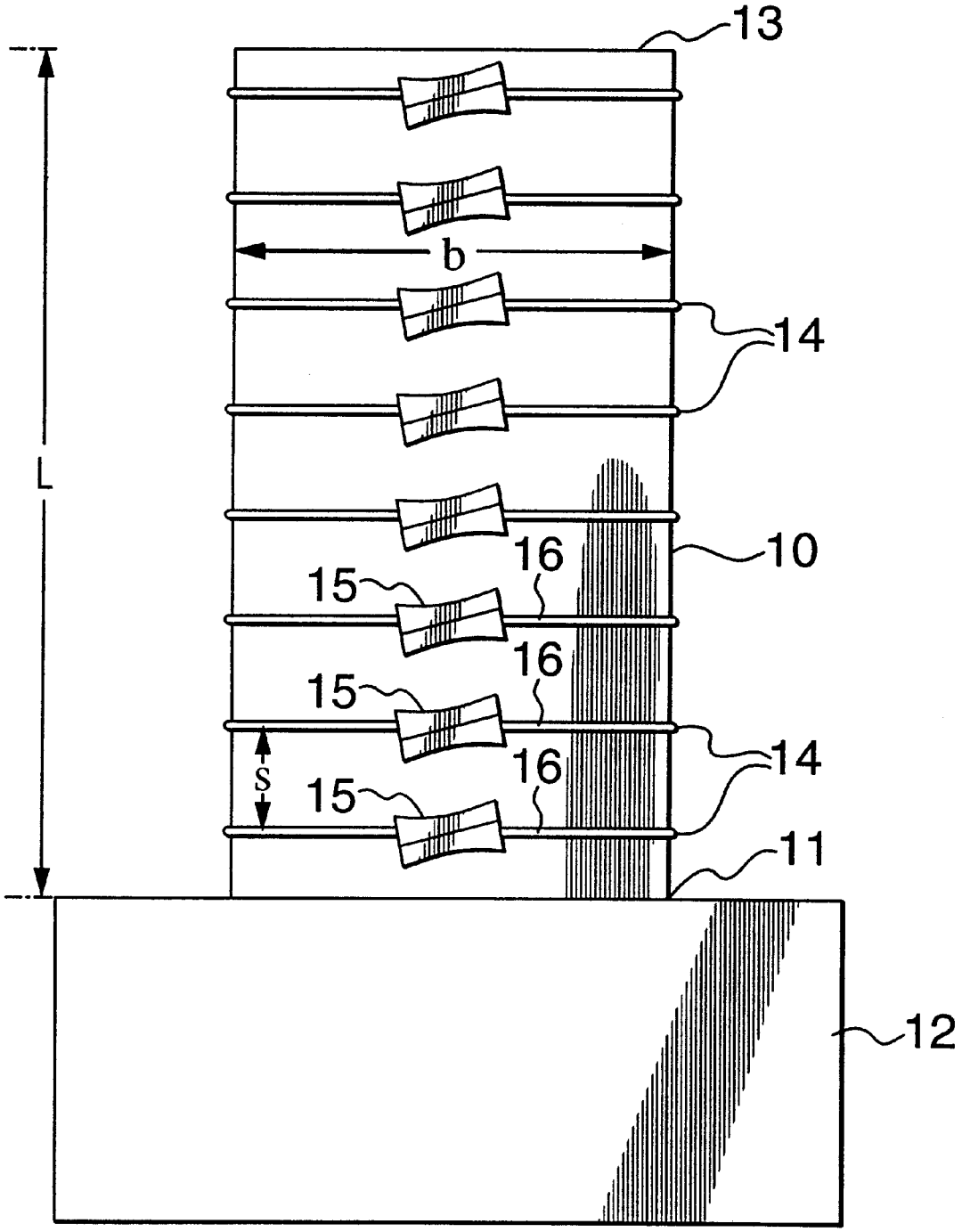
FIG. 3 is an elevation view of part of the circular column showing prestressing hoops mounted about the column.

FIG. 3 illustrates one embodiment of the application of the present invention to a circular concrete column, such as a bridge column where the base of the column is monolithic 11 with the footing 12 and the top is hinged 13. A plurality of prestressing hoops 14 which include strands 16 that encircle the column 10 and are joined by anchor devices 15. In this particular example, the first hoop 14 is positioned 75 mm from the footing 12 and all subsequent hoops 14 are positioned 150 mm apart. It is to be noted that a large variety of elements may be used as strands 16, such as prestressing wire, seven wire strands, carbon fiber strands as well as other metal or non-metal straps, cables, wires, bands and the like that can provide the lateral stress necessary for the column 10 over a long period of time.

Figure 4:
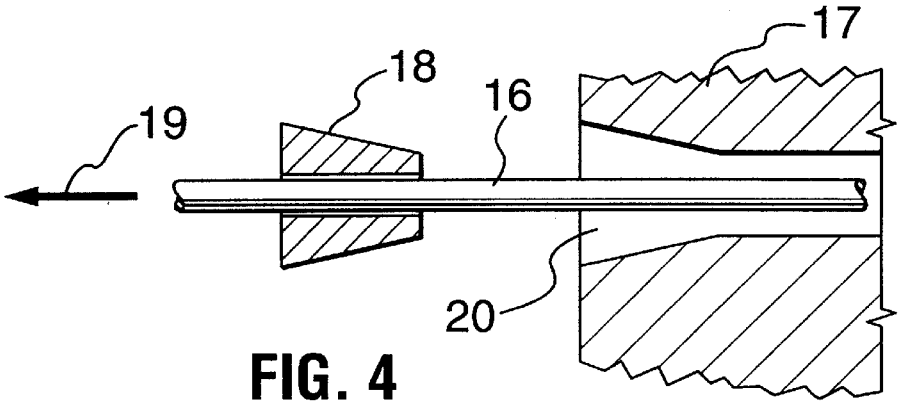
FIG. 4 is a schematic view of anchor system consisting of prestressing wire, wedges, and the nozzle of the anchor.

FIG. 4 shows a typical anchor connection used in a hoop 14 around the column 10. It includes a high-tensile strand 16, an anchor 17, and wedges 18. The strand 16 is pulled or stressed in the direction of the arrow 19. Once the desired stress level in the prestressing strand 16 is reached, the wedges 18 are pushed into the tapered opening 20 of anchor 17 while holding the prestressing strand 16 stationary. Once the wedges 18 are firmly placed into the anchor 17, the prestressing strand 16 is released and wedges 18 grip the prestressing strand 16 with pure friction.

Figure 5A:
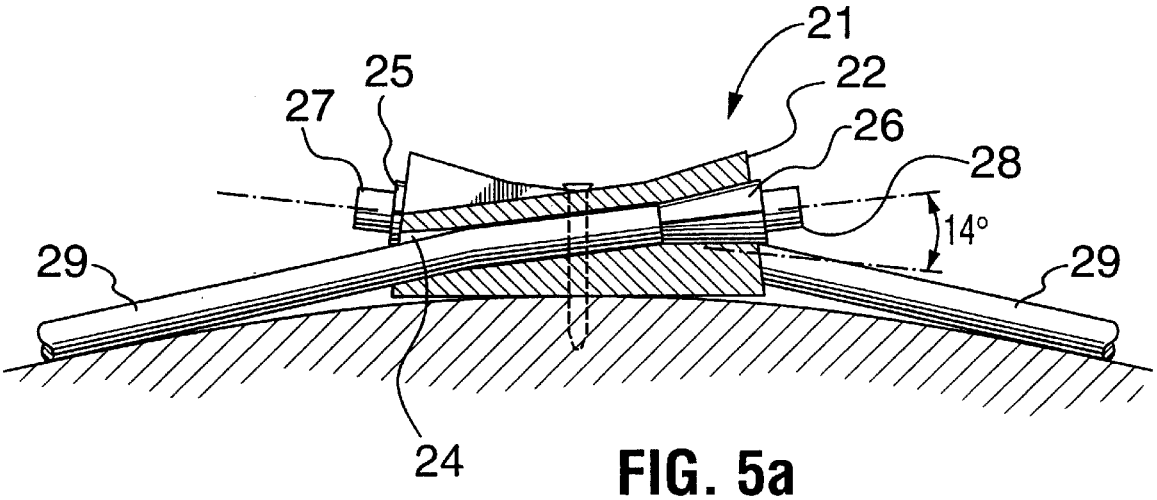
FIG. 5(*a*) is an elevation view in cross-section of a Dywidag anchor.
Figure 5B:
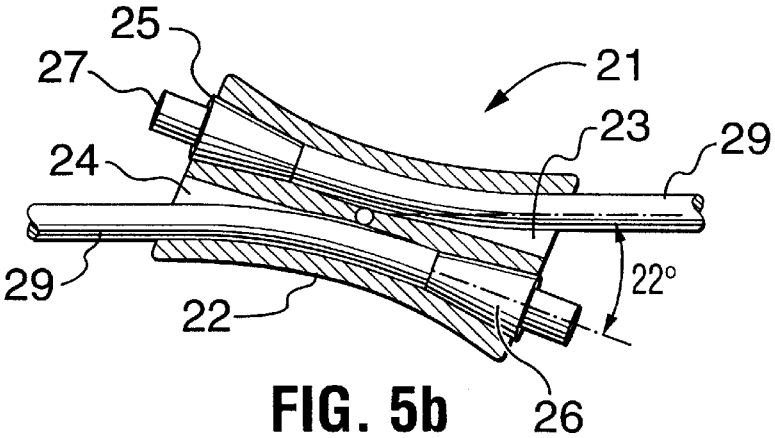

One anchor device which can be used in the implementation illustrated in FIG. 2 is one developed by Dywidag-Systems International. This anchor device 20 is shown schematically in cross section in FIGS. 5*a* and 5*b*. Anchor 21 comprises a block of cast iron 22 with two holes 23 and 24 running through its length. Each hole 23 and 24 has a tapered opening to receive a split cylindrical tapered wedge 25 and 26 respectively to bind the ends 27 and 28 of strand 29 to the anchor 21. As can be seen in FIG. 5(*b*), when tension is place on the strand 29, the anchor 21 will rotate in the plane of the drawing which can result in stress concentration points on the strand 29 at the edge of the anchor 21. Alternate anchoring systems have been developed.

Figure 6A:
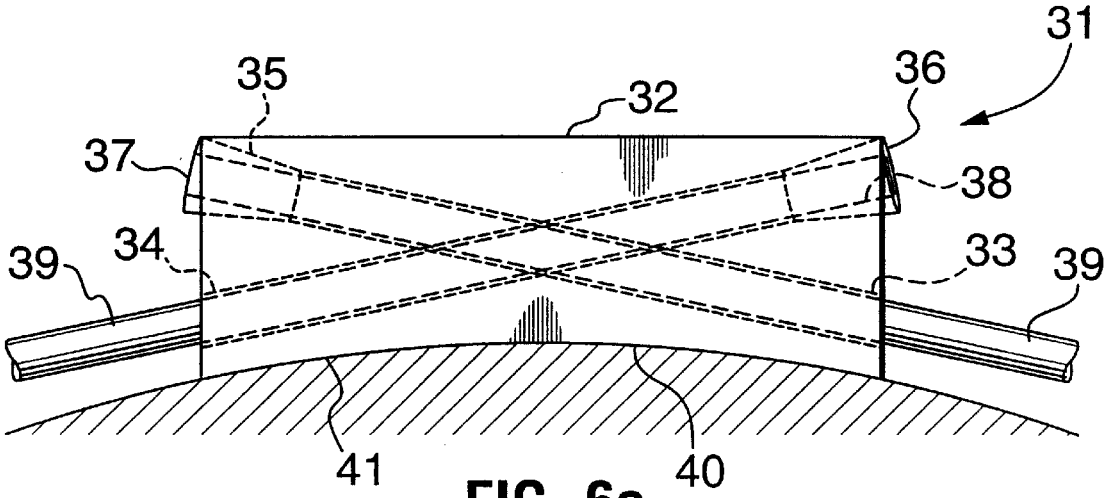
FIG. 6(*a*) is an elevation view in cross-section of the anchor device in accordance with an aspect of the present invention.
Figure 6B:
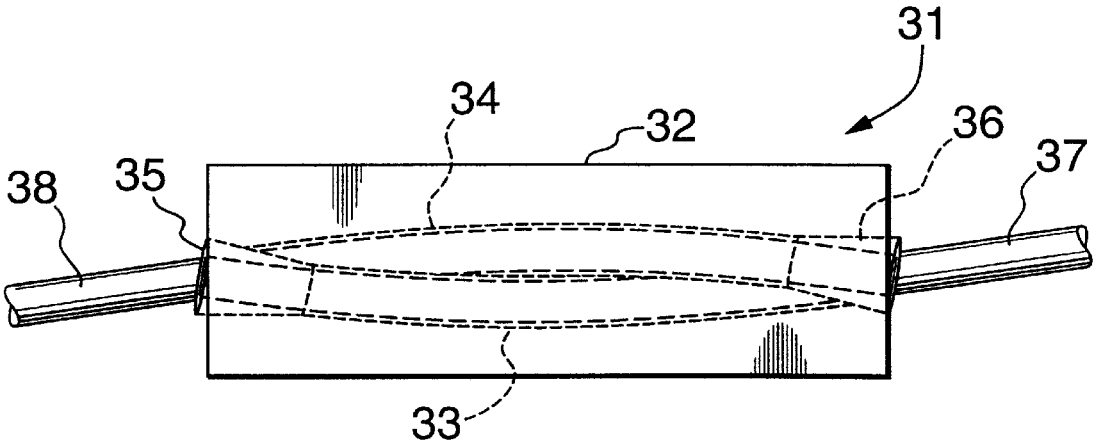

One such anchor 31 is illustrated in FIGS. 6(*a*) and 6(*b*). Anchor 31 comprises a block of cast ductile iron 32 with two holes 33 and 34 running through its length. Each hole 33 and 34 has a tapered opening at opposite ends to receive a split cylindrical tapered wedge 35 and 36 respectively to bind the ends 37 and 38 of strand 39 to the anchor 31. Anchor 31 further includes a curved surface 40 that allows full contact with the curved surface of the column 41. In addition, the center lines of the strand 39 as they exit both ends of anchor 31 subtend an angle somewhat less than 180° between them such that the strand 39 lies close to the column 41 without being forced to bend sharply. In addition as can be seen in the side view in FIG. 6*b,* the strand paths through anchor 31 twist around one another such that the four openings at the two ends of the anchor 31 all fall substantially along a common plane. Thus in operation, when tension is applied to the strand 39, rotation of the anchor 31 is minimized avoiding stress points in the strand 39 caused by sharp bends.

Figure 7:
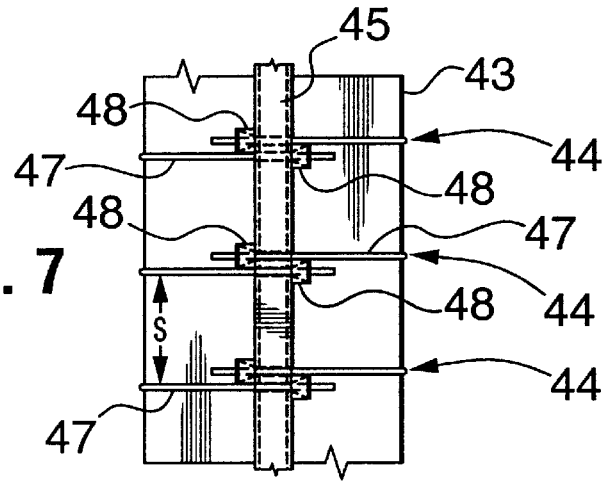
FIG. 7 is an elevation view of part of the circular column showing prestressing cables wrapped around the column and a continuous anchor.
Figure 8:
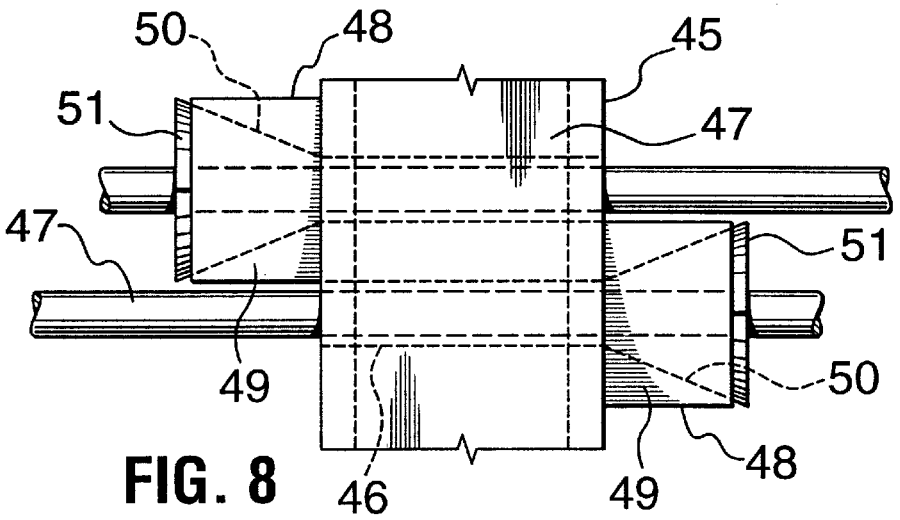
FIG. 8 is an elevation view of the anchorage system described in FIG. 7.

FIGS. 7 and 8 show an alternative manner of anchoring the ends of the prestressing strands 47 along a column 43 to form hoops 44. It includes a hollow structural steel beam (HSS) 45 having a series of spaced pairs of holes 46 to receive the ends of strands 44. The ends of the strands 44 are fixed against the beam 45 by cylindrical anchors 48. The cylindrical anchor 48 consists of a solid cylindrical block 49 with a conical hole 50 along its axis through which is passed the strand 44. Split conical wedges 51 are placed into the conical hole 50 with the prestressing wire 44. The cross sectional dimensions of HSS 45 depends on the amount of prestressing required on strands 44 and spacings between the strands 44.

The stressing procedure is done similarly to the procedure described previously with respect to FIG. 3. One end of the prestressing strand 44 is fixed with wedge 51 inside the cylindrical anchor 48. The other end of the prestressing strand 44 is wrapped around the column 43 and passed through HSS 45 and a second cylindrical anchor 48. Strand 44 is stressed or pulled using a hydraulic jack system and is fixed by the friction of the wedge 51 in the cylindrical anchor 48 at the release of the pressure on the prestressing wire 44.

Figure 9:
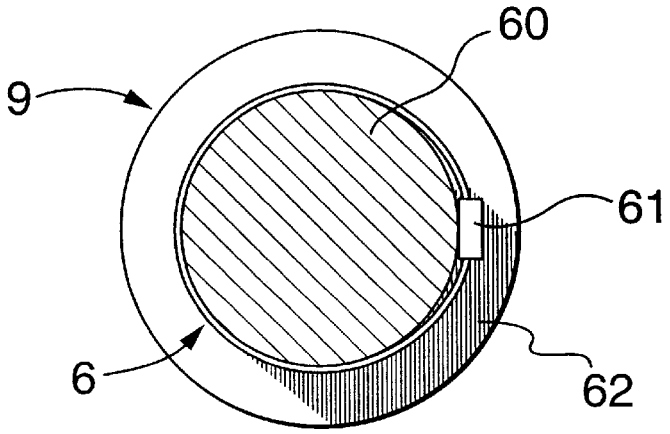
FIG. 9 is a cross section view of a retrofitted circular column with a protective encasement.

It has been found to be desireable to protect the retrofitting devices against corrosion, fire and vandalism, as well as to render the final product more esthetically acceptable. To this end, the column 60 with its associated retrofitting hoops 61 may be covered with some form of encasement 62 as shown schematically in FIG. 9. It is to be noted that the encasement 62 does not contribute to the strength of the column 60. Though for discussion purposes, column 60 is round, it is to be understood that the application of an encasement 62 on other shapes of columns is equally as important, feasible and desirable. The form that the encasement 62 will take, will depend on the location and protection needs of the column 60. An encasement 62 can be placed around the retrofitted column 60 in the form of regular small-aggregate type concrete mixture which can be poured into a formwork or pressure grout can be injected into a formwork using a standard grouting procedure. Alternately, shotcreeting, a standard procedure used in the industry may be employed. In other situations, such as in the retrofitting of rectangular columns or columns within buildings, a ready-made thin shell made out of materials such as gypsum, concrete, steel, any fiber composite, natural stone (granite or marble or equivalent) could be utilized. Columns 60 in which a concrete, grout or shotcreeting type of encasement 62 is required, must have their surfaces prepared prior to the installation of the retrofitting devices. This entails chipping or roughening the concrete using standard chipping equipment and sprayed with a bonding agent and anti-corrosion coating such as SikaTop Armatec 110 in order to bond the existing concrete surface to the new cement-based application. In other situations, a simple coat of paint may provide all of the protection required.

Figure 10A:
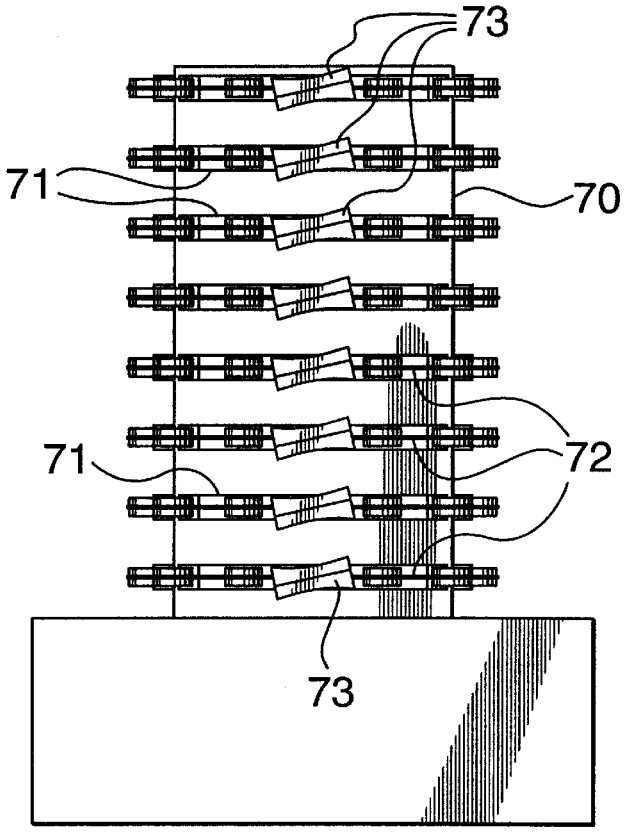
FIG. 10(*a*) is an elevation view of one embodiment of a retrofitted square cross section column.
Figure 10B:
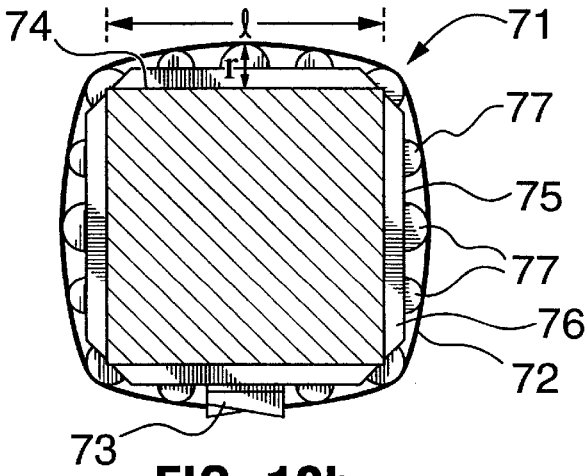

As discussed previously, the present application is equally applicable to columns with cross-sections other than curved cross-sections such as circular or elliptical, i.e. to column shapes having substantially flat surfaces such as square, rectangular, octagonal and the like. FIGS. 10(*a*) and 10(*b*) illustrate one embodiment that the retrofitting devices can take. Column 70 is illustrated as being square and has a number of hoops 71 mounted along the elevation of the column 70. As in previous embodiments, each of the hoops 71 includes a strand 72 and an anchor 73 to join the ends of the strand 72 under stress when mounted about the column 70. However, in addition, in view of the flat surfaces 74 on column 70, raisers 75 are placed between the flat surfaces 74 of the column 70 and the strand 72. In this particular embodiment, the raiser 75 for each flat surface 74 includes a square cross section hollow structural steel beam 76 cut to the length of the flat surface 74 and a number of half discs 77 placed between the beam 76 which is lying flat against the column surface 74 and the strand 72. The number and size of the discs 77 used at each flat surface 74 will depend on the size of the flat surface 74. It is preferred that the curve formed by the strand 72 pressed against the discs be somewhat parabolic in order to apply a relatively equal lateral force against the surface 74 of the column 70. In order to achieve this the ratio of the length l of the surface 74 to the maximum distance r of the strand 72 from the surface 74 should be in the order of 5 to 10:1. If surface 74 is is some curvature to it, discs 77 need not be as large to obtain the desired parabolic curve. Further, ¾ discs 77 are placed in the corners of the column 70 to provide a smooth curve for the strand 72 and to protect the corners from excessive pressures. In addition, the curved edges of the half disc 77 may have channels in them to secure the strand 72 within them.

Figure 11A:
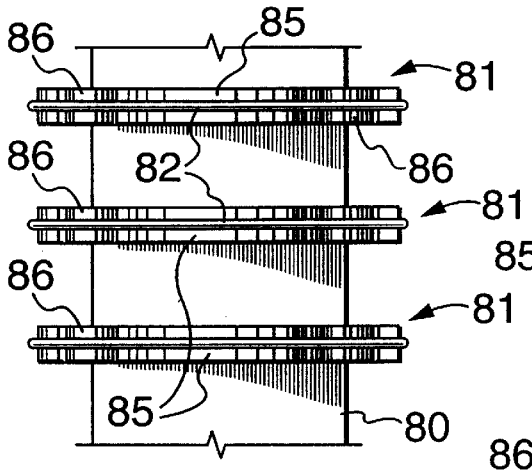
FIG. 11(*a*) is an elevation view of part of a retrofitted rectilinear column.
Figure 11B:
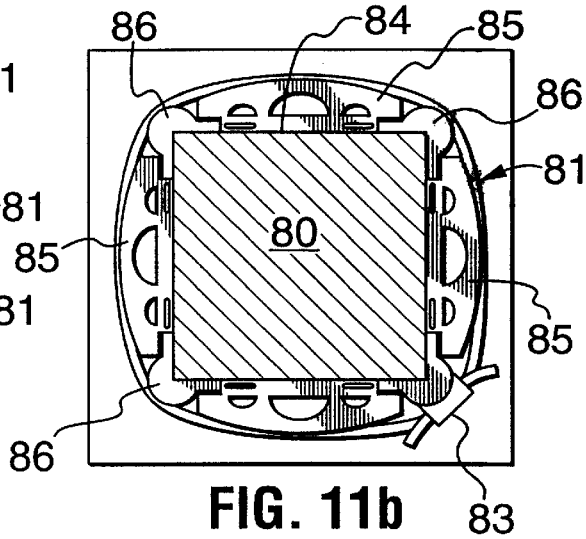

FIGS. 11(*a*) and 11(*b*) illustrate a further embodiment that the retrofitting devices can take on columns having flat surfaces. Column 80 is illustrated as being square and has a number of hoops 81 mounted along the elevation of the column 80. As in previous embodiments, each of the hoops 81 includes a strand 82 and an anchor 83 to join the ends of the strand 82 under stress when mounted about the column 80. However, in addition, in view of the flat surfaces 84 on column 80, a system of raisers 85 and 86 is placed between the column 80 and the strand 82. The flat surface raiser 85 which will be described in detail with respect to FIGS. 12(*a*) and 12(*b*) is designed to apply a relatively equal lateral force against the flat surface 84 of the column 80. The corner raisers 86 provide continuity between adjacent raisers 85 and a smooth transition of prestressing strand 82 between adjacent flat surfaces 84 of the column 80. In this particular embodiment, it has been found convenient to place the anchor 83 on top of one of the corner raisers 86 and the stressing of prestressing strand 82 is applied from this location, however, this need not be the case in all applications.

Figure 12A:
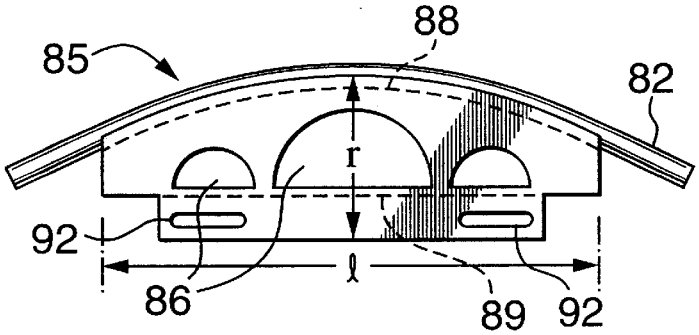
FIG. 12(*a*) is an elevation view of the raiser used for retrofitting rectilinear columns as described in FIGS. 11(*a*) and 11(*b*)
Figure 12B:
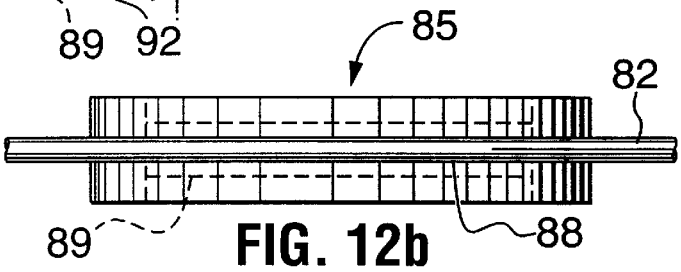

FIG. 12(*a*) shows an elevation view of the raiser 85. It has a parabolic curved edge 87 with a similar parabolic-shaped channel 88. The depth of channel 88 is about half the prestressing strand 82 nominal diameter in order to properly seat the prestressing strand 82. Semi-circular openings 86 are located in the raisers 85 to reduce the weight of the raisers 85 without sacrificing their strength and to provide easy flow of concrete or grout for the construction of an encasement, when required. The bottom portion of the raisers 85 include a channel 89 for connection to the corner raisers 86. Once again, the length l to height r ratio of the raiser should be in the order of 5 to 10:1.

Figure 13A:
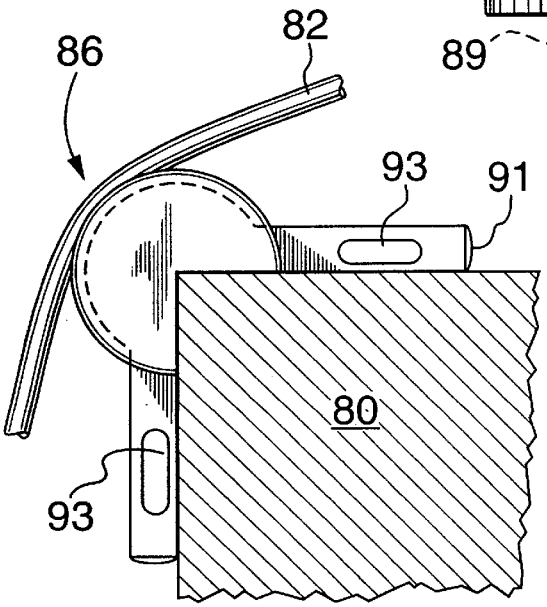
FIG. 13(*a*) is an elevation view of the corner raiser used for retrofitting rectilinear columns as described in FIGS. 11(*a*) and 11(*b*)
Figure 13B:
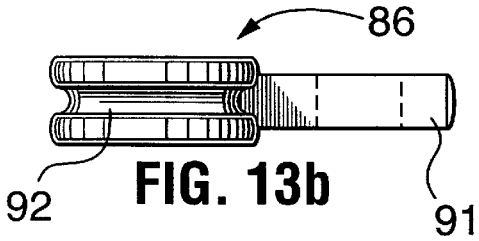
Figure 13C:
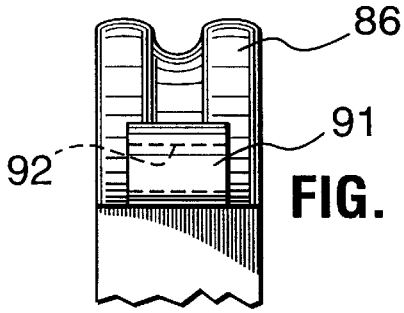

FIGS. 13(*a*), 13(*b*) and 13(*c*) illustrate the corner raiser 86 which includes a ¾ disc corner element 90 connecting two legs 91. The edge of the element 90 includes a channel 92; the depth of the channel 92 is about half of the nominal diameter of the strand 82 to properly seat the strand 82. The legs 91 of the corner raiser 86 are adapted to slide into the channels 89 of raisers 85. These are secured together in place by bolts placed in slots 92 in the raisers 85 and the matching slots 93 in the corner raisers 86. The angle λ between the legs 91 shown in the this figure is 90°. However, this invention is applicable to all polygonal cross sectional columns 80 and thus the angle may be different then 90°.

Figure 14A:
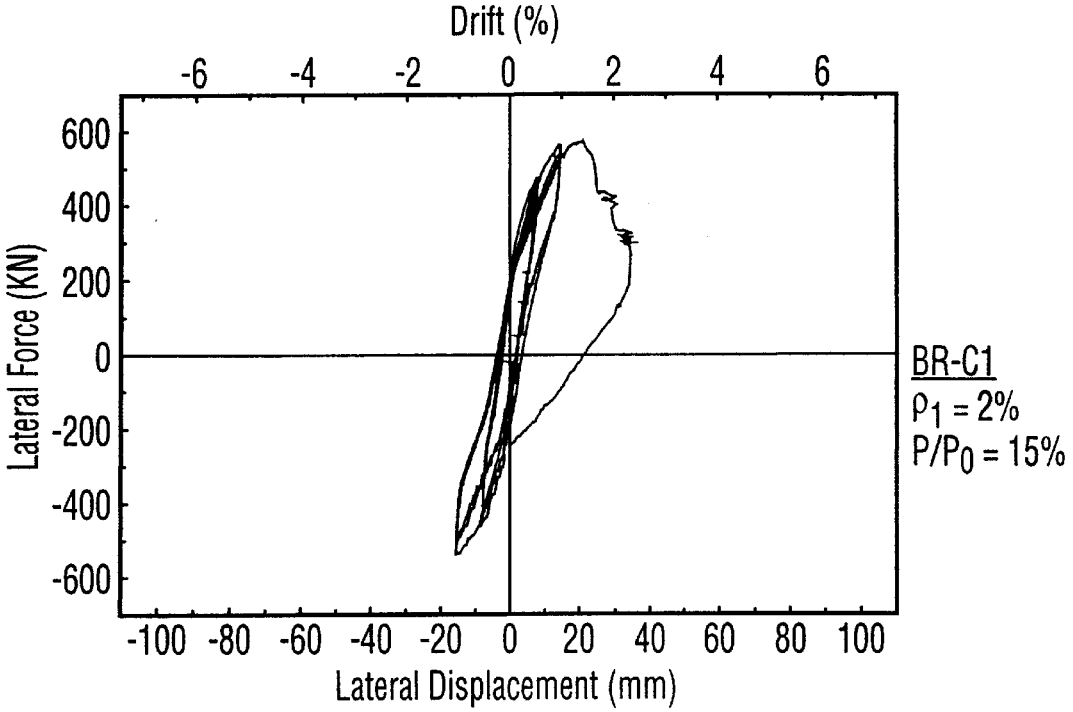
FIG. 14(*a*) is a graph of the performance of a "as designed" circular column in a cyclic test.
Figure 14B:
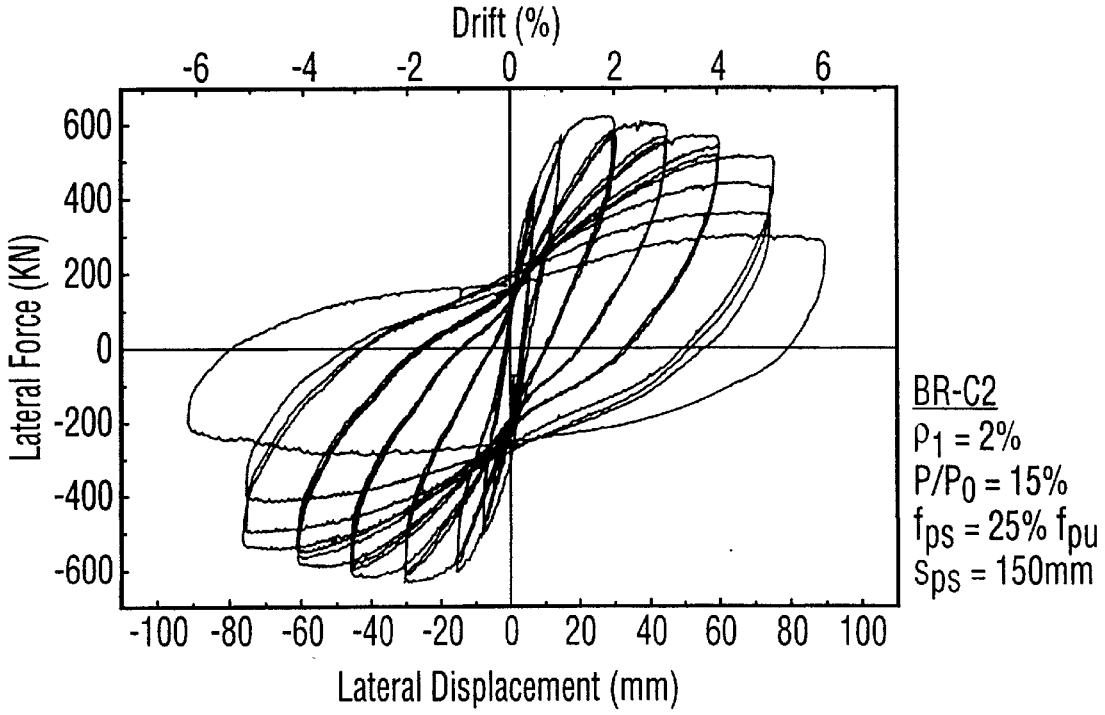

Cyclic tests were performed on two identical circular columns which were constructed to reflect a pre-1970 construction practice resulting in a deficient column under present codes. One of the columns 10 was tested "as designed" and an the other column 10 was "retrofitted" in the manner described with reference to FIG. 3. The columns had a 610 mm diameter section with a 1485 mm cantilever column height (shear span). This translated into an aspect ratio of 2.43. The concrete had a specified strength of 30 MPa. The reinforcing steel was of grade 400 MPa. Twelve No. 25 (25.2 mm diameter) longitudinal reinforcement were uniformly distributed along the section perimeter. Ties, No. 10 (11.3 mm diameter), were placed at 300 mm spacing with the first tie placed at 75 mm from the top of the footing. The circular ties had overlapping ends. The prestressing strand 16 used in the retrofit was a Seven Wire Strand type of Grade 1720 MPa with a 9.53 mm nominal diameter and a designation number 9, as shown in Concrete Design Handbook published by Canadian Portland Cement Association. An initial stress of 25% of the prestressing strand's yield capacity was applied to maintain the active pressure on the column 10. The column was tested under a constant axial load at 15% of $P_o$. FIG. 14(*a*) shows a graph of the performance of the "as designed" column 10 and FIG. 14(*b*) shows a graph of the performance of the "retrofitted" circular columns 10 in the cyclic test. The drift capacities are compared between "as designed" and "retrofitted" columns 10. The results showed that "as designed", in this case a shear-dominant column 10, reaches its elastic capacity at about 1% drift level and abruptly fails at 2% drift. A typical 45-degree shear crack was observed at the end of the testing. This behavior was completely altered when retrofitted in accordance with the present invention; the retrofitted column 10 became a fully ductile column 10 with a drift level of more than 5% while maintaining its integrity and strength.

Figure 15A:
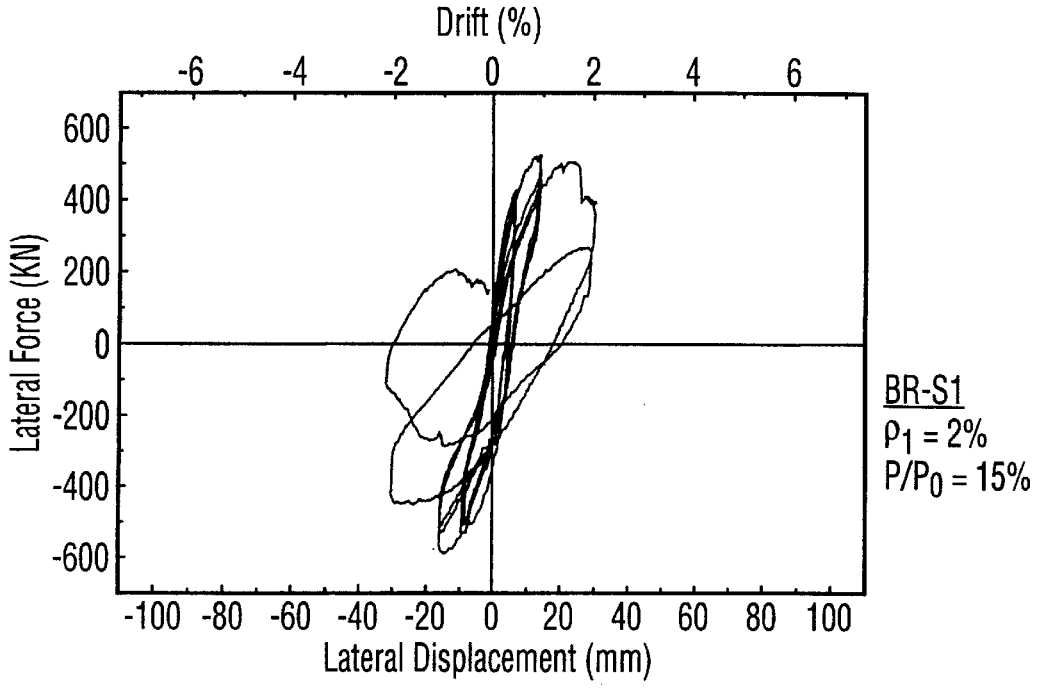
FIG. 15(*a*) is a graph of the performance of a "as designed" square column in a cyclic test.
Figure 15B:
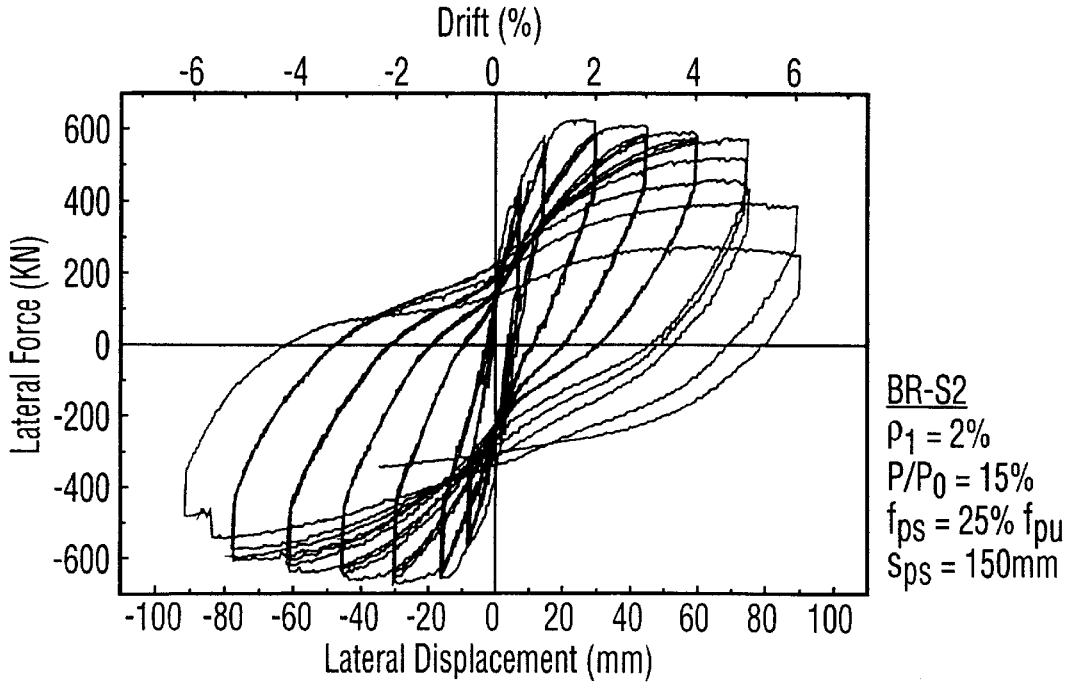

Further cyclic tests were performed on two identical square columns which were constructed to reflect a pre-1970 construction practice resulting in a deficient column under present codes. One of the columns 70 was tested "as designed" and an the other column 70 was "retrofitted" in the manner described with reference to FIGS. 10(*a*) and 10(*b*). The columns had 550 mm wide sides with a 1485 mm cantilever column height (shear span). This translated into an aspect ratio of 2.70. The concrete had a specified strength of 30 MPa. The reinforcing steel was of grade 400 MPa. Twelve No. 25 (25.2 mm diameter) longitudinal reinforcement were uniformly distributed along the section perimeter. Ties, No. 10 (11.3 mm diameter), were placed at 300 mm spacing with the first tie placed at 75 mm from the top of the footing. The square ties had 135° bends at the ends. The prestressing strand 72 used in the retrofit was a Seven Wire Strand type of Grade 1720 MPa with a 9.53 mm nominal diameter and a designation number 9, as shown in Concrete Design Handbook published by Canadian Portland Cement Association. An initial stress of 25% of the prestressing strand's yield capacity was applied to maintain the active pressure on the column 70. The column was tested under a constant axial force of 15% of $P_o$. FIG. 15(*a*) is a graph of the performance of "as designed" and FIG. 15(*b*) is a graph of the performance of the "retrofitted" square column 70 in the cyclic test. Similar observations are obtained as discussed with reference to FIGS. 14(*a*) and 14(*b*). The failure however occurred when longitudinal reinforcement inside the column ruptured through excessive tensile stresses. The "retrofitted" square column 70 maintained its full structural integrity during the entire test process.

Many modifications in the above described embodiments of the invention can be carried out without departing from the scope thereof, and therefore the scope of the present invention is intended to be limited only by the appended claims.

What is claimed is:

1. A method of retrofitting a concrete column to increase its ability to improve its strength and deformability through externally applied transverse prestressing comprising the steps of:

a) determining reinforcement requirements to create active and passive lateral pressure on the column to be retrofitted;

b) selecting hoops having strands and joining means, each hoop adapted to encircle the column once in contact with the column substantially over the entire column face under the hoop for imparting lateral stress to the column;

c) determining the vertical positioning of hoops about the column;

d) placing the hoops about the column; and e) adjusting the tension of the strands in the hoops whereby a substantially uniform pressure is applied to the column face under each hoop to meet the predetermined reinforcement requirements within the critical region.

2. A method as claimed in claim 1 which further comprises the step of:

f) covering the hoops and the column with a protective coating.

3. A method as claimed in claim 1 which further comprises the step of:

f) covering the hoops on the column with a protective coating.

4. A method as claimed in claim 1 wherein step (d) includes placing a first hoop at approximately 75 mm above the base of the column and other hoops at intervals of b/4 or 150 mm whichever is the lesser, where b is the diameter of the circular column.

5. A method as claimed in claim 1 wherein step (d) includes placing a first hoop at approximately 75 mm above the base of the column and other hoops at intervals of b/4 or 150 mm whichever is the lesser, where b is the width of the side dimension of a column along its bending axis.

6. A method as claimed in claim 1 wherein step (b) includes selecting the strands in the hoops using the equation:

$$A_{str-shear} = \frac{[V_{prob} - V_u]S_{str}}{2(1-\alpha_f)\phi_{str}f_{ystr}b}\tan\Theta$$

where $A_{str-shear}$ is the cross-sectional area of high-tensile prestressing strand in $mm^2$ needed for shear deficiency compensation; $V_{prob}$ is the shear force corresponding to probable flexural resistance of the column and may be taken as 1.25 times the nominal flexural capacity of the column divided by the shear span in newtons (N); $V_u$ is design shear capacity of the column in N; $s_{str}$ is the spacing of the hoops in the longitudinal direction in mm; Θ is the inclination of the assumed failure surface caused by diagonal tension and may be taken as 45°; $\alpha_f$ is the ratio of initial prestress to yield strength of the strand; $\phi_{str}$ is the capacity reduction factor of the strand that can be taken as 0.9;$f_{ystr}$ is the yield strength of strand in MPa; and b is the diameter of a circular column or the cross-sectional side dimension of a rectilinear column in the direction of shear force in mm.

7. A method as claimed in claim 1 wherein step (b) includes selecting the strands in the hoops using the equation:

$$A_{str-confine} \geq \frac{f_c'}{f_{ystr}} \frac{bs}{1000}\left(4 + 50\frac{P_f}{P_{or}}\right)$$

where $A_{str-confine}$ is the cross-sectional area of high-tensile prestressing strand in $mm^2$ needed for confinement deficiency compensation; $f_c$ is the compressive strength in MPa as determined by a standard cylinder test; $f_{ystr}$ is the yield strength of strand in MPa; b is the diameter of a circular column or the cross-sectional side dimension of a rectilinear column parallel to the axis of bending in mm; $s_{str}$ is the spacing of the hoops in the longitudinal direction in mm; $P_f$ is the factored axial compressive force due to the combination of gravity and lateral loads in N and $P_{or}$ is the factored concentric capacity of the column in N.

8. A method as claimed in claim 1 wherein step (b) includes:

b1) calculating $A_{str-shear}$ —the cross-sectional area of high-tensile prestressing strand in $mm^2$ needed for shear deficiency compensation;

b2) calculating $A_{str-confine}$—the cross-sectional area of high-tensile prestressing strand in $mm^2$ needed for confinement deficiency compensation; and b3) selecting the strands on the basis of the larger of the two cross-sectional areas $A_{str-shear}$ and $A_{str-confine}$.

9. A method as claimed in claim 1 wherein step (a) includes the steps of:

a1) calculating the design shear capacity $V_u$ of the column;

a2) calculating the probable shear force $V_{prob}$ of the column;

a4) determining whether $V_{prob} \geqq V_u$ wherein retrofitting is required.

10. A method as claimed in claim 1 wherein step (a) includes the step of determining the conformity of the existing transverse reinforcement in the column to predetermined confinement steel requirements wherein nonconformity denotes the need for retrofitting.

11. A method as claimed in claim 1 wherein step (e) includes the steps of:

e1) fixing one end of the strand in the joining means;

e2) placing the other end of the strand in the joining means under tension and fixing it in the joining means.

12. A kit for retrofitting concrete columns having a curved surface through externally aplied transverse prestressing to create active and passive lateral pressures, comprising:

a plurality of high tensile prestressing strands for mounting about the column, each strand having a length to encircle the column once; and a plurality of anchors each adapted to join the two ends of a strand to hold the strand under tension against the column for creating the active and passive pressures on the column.

13. A kit for retrofitting concrete columns having a curved surface as claimed in claim 12 wherein the strands are wire or carbon fiber strands.

14. A kit for retrofitting concrete columns having a curved surface as claimed in claim 12 wherein the joining anchors each comprise a block having two adjacent holes passing through the block to define adjacent openings on opposite ends of the block, the holes being sufficiently large for a strand to pass through them, wherein one opening for each hole located at opposite ends of the block has tapered walls for receiving a tapered wedge to fix the strand under tension within the block.

15. A kit for retrofitting concrete columns having a curved surface as claimed in claim 12 wherein the joining anchors comprise:

one or more rectilinear beams having pairs of adjacent holes through the beam spaced along the length of the beam; and a cylindrical single opening anchor located at each of the holes wherein one anchor at each pair of holes is adapted to fix one end of the strand to the beam and another anchor at each pair of holes is adapted to fix the other end of the strand to the beam.

16. A kit for retrofitting concrete columns having a curved surface as claimed in claim 12 wherein the joining anchors each comprise a block having two adjacent holes passing through the block to define adjacent openings on opposite ends of the block, the holes being sufficiently large for a strand to pass through them, wherein one opening for each hole located at opposite ends of the block has tapered walls for receiving a tapered wedge to fix the strand under tension within the block and wherein the holes within the block define adjacent twisted paths through the block.

17. A kit for retrofitting concrete columns having substantially flat surfaces through externally applied transverse prestressing to create active and passive lateral pressures, comprising:

a plurality of lengths of high tensile strands for mounting about the column in the form of one or more strands;

a plurality of raisers for placement between the strands and each flat surface of the column; and a plurality of anchors each adapted to join the two ends of a stand to hold the strand under tension for creating the active and passive pressures on the column.

18. A kit for retrofitting concrete columns having substantially flat surfaces as claimed in claim 17 wherein each raiser comprises:

a beam having a length substantially equal to the width of the flat column surface;

a plurality of half discs fixed to the beam along their flat edge, the discs being sized such that the apexes of the discs form an arc that is substantially parabolic.

19. A kit for retrofitting concrete columns having substantially flat surfaces as claimed in claim 18 wherein the ratio of the length of the substantially flat surface to the width of the beam and the largest half disk is in the order of 5 to 10:1.

20. A kit for retrofitting concrete columns having substantially flat surfaces as claimed in claim 17 wherein the strands are wire or carbon fiber strands.

21. A kit for retrofitting concrete columns having substantially flat surfaces as claimed in claim 17 wherein the joining anchors each comprise a block having two adjacent holes passing through the block to define adjacent openings on opposite ends of the block, the holes being sufficiently large for a strand to pass through them, wherein one opening for each hole located at opposite ends of the block has tapered walls for receiving a tapered wedge to fix the strand under tension within the block.

22. A kit for retrofitting concrete columns having substantially flat surfaces as claimed in claim 19 and further comprising:

a plurality of corner spacers for placement between the strands and each corner joining adjacent flat surfaces.

23. A kit for retrofitting concrete columns having substantially flat surfaces as claimed in claim 17 wherein each raiser comprises an elongated plate having a predetermiined thickness wherein one edge along the length is substantially flat and the opposite edge is generally parabolic, the parabolic edge further having a channel to receive the strand.

24. A kit for retrofitting concrete columns having flat surfaces as claimed in claim 23 wherein the ratio of the length of the raiser to the width of the raiser is in the order of 5 to 10:1.

25. A kit for retrofitting concrete columns having substantially flat surfaces as claimed in claim 19 and further comprising:

a plurality of corner raisers for placement between the strand and each corner joining adjacent flat surfaces.

26. A kit for retrofitting stationary vertical concrete columns having substantially flat surfaces as claimed in claim 20 wherein each of the corner raisers comprises a half disc element having a predetermined thickness and having two legs fixed at predetermined angle with respect to one another, the curved edge of the disc having a channel to receive the strand.

27. A kit for retrofitting concrete columns having substantially flat surfaces as claimed in claim 21 wherein the joining anchors each comprise a block having two adjacent holes passing through the block to define adjacent openings on opposite ends of the block, the holes being sufficiently large for a strand to pass through them, wherein one opening for each hole located at opposite ends of the block has tapered walls for receiving a tapered wedge to fix the strand under tension within the block and wherein the holes within the block define adjacent twisted paths through the block.

28. An anchor for joining two strand ends under tension comprising: a block having two adjacent holes passing through the block to define adjacent openings on opposite ends of the block, the holes being adapted to receive a strand, wherein one opening for each hole located at opposite ends of the block has tapered walls for receiving a tapered wedge for fixing the strand under tension within the block and wherein the holes within the block define adjacent twisted paths through the block.

29. An anchor for joining two strand ends under tension as claimed in claim 28 wherein the hole paths twist 180° about one another through the block.

30. An anchor for joining two strand ends under tension as claimed in claim 29 wherein one surface perpendicular to the plane defined by the hole openings in the block is a planar concave surface.

* * * * *

UNITED STATES PATENT AND TRADEMARK OFFICE

CERTIFICATE OF CORRECTION

PATENT NO. : 6,247,279 B1
DATED : June 19, 2001
INVENTOR(S) : Murat Saatcioglu and Cem Yalcin It is certified that error appears in the above-identified patent and that said Letters Patent is hereby corrected as shown below:

Title page,
Item [30], Foreign Application Priority Data
Mar. 24, 1998 [CA] Canada ..... 2233025
Item [75], "Saatcioglu Murat, Gloucester; Yalcin Cem, Ottawa, both of (CA)" should be -- Murat Saatcioglu, Gloucester; Cem Yalcin, Ottawa, both of (CA) --

Column 4,
Line 59, "where $f_c$ is" should be -- $f'_c$ is --.

Column 5,
Line 6, "forjoining" should be -- for joining --.
Line 35, "atypical" should be -- a typical --.

Column 6,
Line 33, "Ia" should be -- 1a --.
Line 54, "fill" should be -- full --.

Column 8,
Line 16, "where $f_c$ is" should be -- where $f'_c$ is --.

Column 13,
Line 22, "compensation; $f_c$ is" should be -- compensation; $f'_c$ is --.
Line 46, list goes al) a2) a4) should be -- al) a2) a3) --.

Column 14,
Line 43, "ends of a stand" should be -- ends of a strand --.

Signed and Sealed this

Ninth Day of April, 2002

*Attest:*

*Attesting Officer*

JAMES E. ROGAN
*Director of the United States Patent and Trademark Office*